United States Patent [19]

Fleissner

[11] 4,229,173

[45] Oct. 21, 1980

[54] PROCESS AND APPARATUS FOR THE CONTINUOUS DYEING OF LENGTHS OF MATERIAL CONSISTING AT LEAST PARTLY OF CELLULOSE FIBERS

[75] Inventor: Heinz Fleissner, Frankfurt am Main, Fed. Rep. of Germany

[73] Assignee: Vepa AG, Switzerland

[21] Appl. No.: 375,028

[22] Filed: Jun. 29, 1973

[30] Foreign Application Priority Data

Jun. 29, 1972 [DE] Fed. Rep. of Germany ..... 2231767

[51] Int. Cl.[3] ..... D06P 1/22; D06P 5/20; D06B 1/12; D06B 13/00; D06B 23/24

[52] U.S. Cl. ..... 8/519; 8/149.3; 8/159; 68/50; 8/476; 8/650

[58] Field of Search ..... 8/34, 74, 73, 33, 149.3, 8/159, 17, 24, 22

[56] References Cited

U.S. PATENT DOCUMENTS

| | | | |
|---|---|---|---|
| 1,131,270 | 3/1915 | Quick | 8/34 |
| 2,396,908 | 3/1946 | Womble | 8/34 X |
| 2,447,993 | 8/1948 | Vieira | 8/34 |
| 2,487,197 | 11/1949 | Stott et al. | 8/34 X |
| 2,764,010 | 9/1956 | Williams | 8/34 X |
| 3,804,590 | 4/1974 | Fleissner | 8/149.3 X |

FOREIGN PATENT DOCUMENTS

| | | | |
|---|---|---|---|
| 742207 | 12/1955 | United Kingdom | 8/73 |
| 821327 | 10/1959 | United Kingdom | 8/159 |

OTHER PUBLICATIONS

Daiwa Vibro-Washer, American Dyestuff Reporter, vol. 53, No. 4, p. 66 (157), (Feb. 17, 1964).

*Primary Examiner*—Teddy S. Gron
*Attorney, Agent, or Firm*—Craig & Antonelli

[57] ABSTRACT

An improved process for the continuous dyeing of lengths of textile material that at least partly contain cellulose fibers by the Pad-Steam process wherein the textile material onto which dyestuff has been applied is impregnated with chemical reducing agents including an alkaline sclution, is then transported into a steamer for dyestuff-fixation by steaming thereon, is then after-treated by the sequential steps of rinsing with a liquor to remove the reducing agents, oxidizing the dyestuff with a liquor, and soaping and again rinsing the material with a liquor, and then finally drying the material. The improvement in the process comprises effecting the after-treatment steps, at least partially, by forcing the appropriate liquors through the material, especially on the perforated surface of a suction drum.

1 Claim, 2 Drawing Figures

Figure 1:
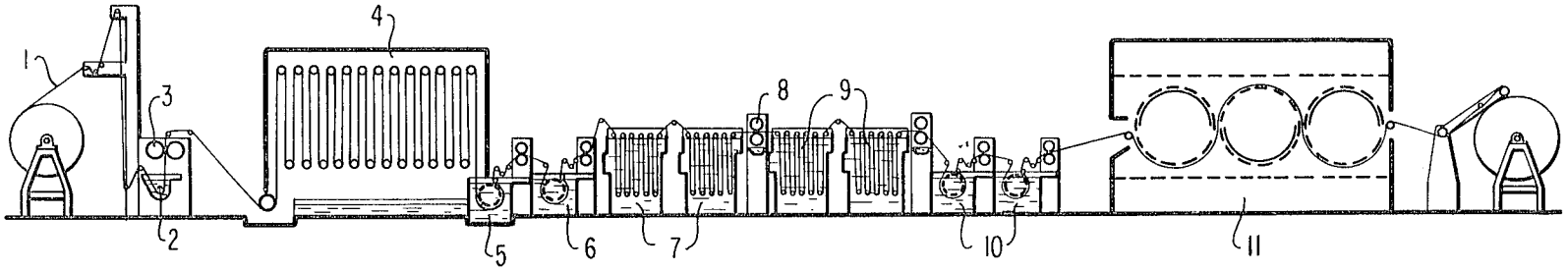

PROCESS AND APPARATUS FOR THE CONTINUOUS DYEING OF LENGTHS OF MATERIAL CONSISTING AT LEAST PARTLY OF CELLULOSE FIBERS

This invention relates to an improved process of continuous dyeing of lengths of textile material which consists at least partly of cellulose fibers, wherein the material to which dyestuff has been applied is impregnated with chemical reducing agents, is then transported to a steamer for dyestuff-fixation and is then after-treated, such as rinsing, oxidizing, soaping, again rinsing and finally drying.

The continuous dyeing of cellulose fibers with vat dyes which became known by the American Pad-Steam process starts by putting undissolved dyestuff in the form of a suspension on and into the fibers. If the material also contains polyester fibers among others, these polyester fibers, by means of the dyestuff applied thereon, are first dyed according to the Thermosol process. Thereafter, the dry material is forwarded to the Pad-Steam unit, where, in a chemicals padder, the dyestuff is reduced by caustic soda solution and an alkali hydrosulphite. In this reduced state the dyestuff has a high affinity for the fibers, so that a high yield results in good dyeing. Thereafter, follows actual dyeing in a dyestuff-fixation apparatus, under the influence of heat, mostly in a steamer. The dyestuff which at this stage has been absorbed by the fibers, now requires after-treating to ensure permanency. For this purpose, the alkaline residues on the material must be removed and the dyestuff must be oxidized. The following acid treatment or soaping and rinsing serve to neutralize the material. After drying the Pad-Steam process is completed.

For the after-treatment of the textile material, up to now, eight to ten large washbowls were required. In these washbowls the material had to dwell for a longer period of time. These washbowls, usually in the form of roller vats, took up a large amount of floor space. Also, chemicals and water consumption were substantial which, together, rendered the continuous dyeing of cellulose fibers an altogether uneconomical proposition for medium-sized companies.

The purpose of this invention is to develop a process and apparatus to carry out this known process, when this after-treatment can be expedited and intensified without impairing the quality of the finished product.

The process according to this invention is characterized in that the after-treatment is carried out, at least partly, by forcing liquor through the textile material. In particular, rinsing for removing the alkaline solution and rinsing after soaping or acid treatment should be carried out by forcing liquor through the material, because rinsing is not determined by time, whilst oxidizing and soaping for completing the treatment of the dyestuff are subject to a certain treating time.

It is of particular advantage if the alkaline solution is removed by liquor which is forced through the material, directly after steaming without that the material is subjected to the influence of the oxygen of the air, because this will result in a much more uniform treatment. Oxidizing of the dyestuff naturally must be effected by oxidizing agents which are added to the subsequent treatment bowl and not by the oxygen of the air.

The apparatus for carrying out the Pad-Steam process comprises a chemicals padder, a steamer, e.g. of the testoon type, one or two suction drum bowls for removing the alkaline solution, of which preferentially the first should form part of the steamer discharge, one or two roller vat bowls for soaping, i.e. especially acid treatment, and finally one or two suction drum bowls for rinsing. Finally, a dryer which, advantageously should be a perforated drum dryer. Such an apparatus is much shorter in length than the previously known arrangement, and it is substantially more economical to operate.

Figure 2:
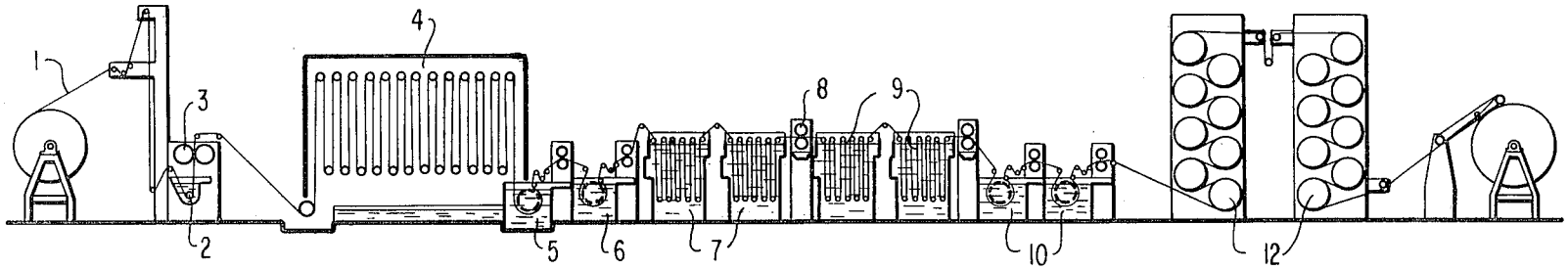

The enclosed drawing shows two embodiments of this invention, by way of example wherein:

FIG. 1 shows an elevational view of an apparatus for effecting the improved Pad-Steam process of the invention; and FIG. 2 shows another apparatus for effecting this process.

The embodiments shown only differ in the construction of the final dryer. In both embodiments, the length of textile material 1 containing cellulose fibers in the form of a web, sheet band or the like and impregnated with an appropriate dyestuff used in the conventional Pad-Steam process is fed to the chemicals padder from a batch, wherein the dyestuff is reduced by a caustic soda solution and an alkali hydrophosphite. In the squeeze rolls 3 the liquor-pick-up is evenedout and reduced to a certain percentage. Afterwards, the material passes on into the steamer 4 where it stays for a certain period of time. The steamer is shown schematically only. Any type of steamer may be employed, but preferably one where the material is guided in very close arrangement.

The steamer discharge is formed as a suction drum bowl 5, in that the feed end of this bowl is arranged within the steamer. The textile material adheres to the suction drum, i.e., a sieve drum having a perforated surface, of this bowl and, at the same time, is penetrated by the liquor, and so it has lost the major part of the alkaline residues when it discharges from this bowl outside of the steamer, without that any oxygen from the air has been in contact with the material or has reacted with the dyestuff. Another suction drum bowl 6 effects a most intensive cleaning of the material which is a prerequisite for the subsequent oxidation in the roller vat bowls 7. After passing through a squeeze head 8 (made up of a pair of rollers) the acidized material is neutralized in the roller vat bowls 9 and, in the following two suction drum bowls 10, the material is completely cleaned of all chemical residues, thus completing the after-treatment process.

After this Pad-Steam treatment, the material only requires to be dried which, as shown in FIG. 1, may be done in a perforated drum dryer 11 or, as shown in FIG. 2, may be effected on drying cans or rollers 12. All individual units in FIG. 2 preceding the drying cans are the same as in FIG. 1.

The apparatus as described above may advantageously also be employed for bleaching, e.g., where only minor changes will be required. It is essential, in this context, that all processes where an intensive treatment is of advantage, are to be effected in suction drum bowls, where the liquor is bodily forced through the material.

It will be appreciated from the foregoing detailed description that the process of this invention is concerned with an improvement in the manipulative steps of the Pad-Steam process and that the conditions, dyestuffs and after-treating agents used are those conventionally employed in the Pad-Steam process.

While the novel embodiments of the invention have been described, it will be understood that various omissions, modifications and changes in these embodiments may be made by one skilled in the art without departing from the spirit and scope of the invention.

What I claim is:

1. In a process for the continuous dyeing of lengths of textile material, which, at least partly, contains cellulose fibers by the Pad-Steam process wherein the textile material onto which dyestuff has been applied is impregnated with chemical reducing agents including an alkaline solution, is transported into a steamer for dyestuff-fixation by steaming therein, is after-treated by the sequential steps of rinsing with a liquor to remove the alkaline solution, oxidizing the dyestuff in the material with a liquor, and soaping and again rinsing with a liquor to neutralize the material and then is finally dried, the improvement which comprises effecting the rinsing step required for removing the alkaline solution and the rinsing step after soaping by conveying the material on a perforated surface of a suction drum means and by forcing the appropriate rinsing liquors through the material being conveyed on said suction drum means, removal of the alkaline solution after steaming being effected within the discharge portion of said steamer by the rinsing liquor being forced through the material in direct succession after the steaming whereby the oxygen of the air has no contact with the material.

* * * * *